US012674627B2

(12) United States Patent
Roberts et al.

(10) Patent No.: US 12,674,627 B2
(45) Date of Patent: Jul. 7, 2026

(54) SYSTEMS AND METHODS FOR HEAT TRANSFER USING HEAT PIPES

(71) Applicant: Trane Technologies Life Sciences LLC, Davidson, NC (US)

(72) Inventors: Alex Roberts, Parkersburg, WV (US); Trace A. Lydick, Athens, OH (US)

(73) Assignee: Trane Technologies Life Sciences LLC, Davidson, NC (US)

( * ) Notice: Subject to any disclaimer, the term of this patent is extended or adjusted under 35 U.S.C. 154(b) by 283 days.

(21) Appl. No.: 18/356,654

(22) Filed: Jul. 21, 2023

(65) Prior Publication Data

US 2025/0027725 A1 Jan. 23, 2025

(51) Int. Cl.
*F28D 15/02* (2006.01)
*F25B 21/02* (2006.01)

(52) U.S. Cl.
CPC ..... *F28D 15/0275* (2013.01); *F25B 21/02* (2013.01); *F25B 2321/023* (2013.01); *F25B 2321/0252* (2013.01)

(58) Field of Classification Search
CPC .... F28D 1/024; F28D 1/0417; F28D 15/0233; F28D 15/00; F25D 25/028; A47F 3/0491
See application file for complete search history.

(56) References Cited

U.S. PATENT DOCUMENTS 3,713,302 A 1/1973 Reviel
4,067,237 A 1/1978 Arcella
4,106,554 A 8/1978 Arcella
4,339,929 A 7/1982 Fitzpatrick et al.
4,858,445 A 8/1989 Rasovich
5,355,684 A 10/1994 Guice
5,863,715 A 1/1999 Rajotte et al.
6,070,654 A 6/2000 Ito
6,202,425 B1 3/2001 Arshansky et al.
6,863,118 B1 3/2005 Wang et al.
8,012,416 B2 9/2011 Kuzyk
9,062,920 B2 6/2015 Hsieh
9,791,184 B2 10/2017 Novisoff et al.
11,022,380 B2 6/2021 Zhao et al.
(Continued)

FOREIGN PATENT DOCUMENTS

JP H1089831 A * 4/1998
KR 20130119282 A * 10/2013 ..... F25D 23/006
(Continued)

OTHER PUBLICATIONS

Ono (JPH1089831A) English Translation (Year: 1998).*
(Continued)

*Primary Examiner* — Elizabeth J Martin
*Assistant Examiner* — Keona Lauren Banks
(74) *Attorney, Agent, or Firm* — Womble Bond Dickinson (US) LLP

(57) ABSTRACT

An embodiment of a system for changing a temperature of a packaged biologic substance includes a chamber configured to receive the packaged biologic substance. In addition, the system includes a refrigeration assembly configured to change a temperature of the packaged biologic substance. Further, the system includes an auxiliary heat exchanger at least partially positioned in the chamber, the auxiliary heat exchanger including at least one heat pipe.

20 Claims, 9 Drawing Sheets

(56) References Cited

U.S. PATENT DOCUMENTS

| | | | | |
|---|---|---|---|---|
| 11,067,327 | B2 | 7/2021 | Alexander et al. | |
| 11,162,716 | B2 | 11/2021 | Alexander et al. | |
| 11,221,184 | B1 | 1/2022 | Weed et al. | |
| 2005/0051301 | A1 | 3/2005 | Hsu | |
| 2006/0278369 | A1* | 12/2006 | Maidment | F25D 25/028 165/104.21 |
| 2010/0158794 | A1 | 6/2010 | Steer | |
| 2010/0212331 | A1 | 8/2010 | Critser et al. | |
| 2012/0090160 | A1 | 4/2012 | Shaham | |
| 2012/0192574 | A1* | 8/2012 | Ghoshal | F25B 21/02 62/3.2 |
| 2014/0138058 | A1 | 5/2014 | Hyde | |
| 2014/0260346 | A1 | 9/2014 | Fuhr et al. | |
| 2017/0198948 | A1 | 7/2017 | Konig et al. | |
| 2019/0368822 | A1 | 12/2019 | Hofacker et al. | |
| 2020/0107993 | A1* | 4/2020 | Cutting | F25D 17/06 |
| 2021/0154381 | A1 | 5/2021 | Fischbach et al. | |
| 2022/0057144 | A1* | 2/2022 | Nakashima | H05K 7/20336 |
| 2022/0146205 | A1 | 5/2022 | Eronen et al. | |
| 2022/0174943 | A1* | 6/2022 | Skiba | A61L 2/10 |

FOREIGN PATENT DOCUMENTS

| | | | | |
|---|---|---|---|---|
| WO | WO-2007053148 | A1 * | 5/2007 | A47F 3/0447 |
| WO | 2013148080 | | 10/2013 | |

OTHER PUBLICATIONS

Kim (KR20130119282A ) English Translation (Year: 2013).*
"Cold Plates," ThermAvant Technologies, https://www.thermavant.com/cold-plates first accessed Jun. 21, 2023, pp. 1-2.

* cited by examiner

SYSTEMS AND METHODS FOR HEAT TRANSFER USING HEAT PIPES

CROSS-REFERENCE TO RELATED APPLICATIONS

Not applicable.

TECHNOLOGICAL FIELD

This disclosure generally relates to systems and related assemblies for freezing or thawing a substance. More particularly, this disclosure relates to systems and related assemblies that are configured to freeze or thaw a biologic substance.

BACKGROUND

Biologic substances, such as biological materials and samples and pharmaceutical products (e.g., vaccines or other medicines), may be frozen for storage or transport. In some instances, a biologic substance may be frozen to a substantially low temperature (e.g., such as temperatures that are below −40° C.) to prevent degradation, improve shelf life, etc. However, in addition to the target storage temperature, the rate of temperature change, both during freezing and thawing of the biologic substance, may be an important consideration. For instance, it may be desirable to control the rate of temperature change (e.g., freezing or thawing) of the biologic substance, to allow the biologic substance to evenly and quickly freeze or thaw, and to prevent degradation thereof.

BRIEF SUMMARY

Some embodiments disclosed herein are directed to a system for changing a temperature of a packaged biologic substance. In some embodiments, the system includes a chamber configured to receive the packaged biologic substance. In addition, the system includes a refrigeration assembly configured to generate an airflow through the chamber to change a temperature of the packaged biologic substance. Further, the system includes an auxiliary heat exchanger at least partially positioned in the chamber, the auxiliary heat exchanger comprising at least one heat pipe that is configured to transfer heat between the packaged biologic substance and the airflow.

Some embodiments disclosed herein are directed to a method of changing a temperature of a packaged biologic substance. In some embodiments, the method includes (a) contacting the packaged biologic substance with a first portion of an auxiliary heat exchanger within a chamber, the auxiliary heat exchanger also including a second portion and at least one heat pipe extending between the first portion and the second portion. In addition, the method includes (b) generating an airflow with a refrigeration assembly. Further, the method includes (c) circulating the airflow between the chamber and the refrigeration assembly so that the airflow: (i) contacts the packaged biologic substance in the chamber to transfer heat between the packaged biologic substance and the airflow, and (ii) contacts the second portion of the auxiliary heat exchanger to transfer heat between the packaged biologic substance and the airflow via the heat pipe.

Some embodiments disclosed herein are directed to a system for cooling a packaged biologic substance. In some embodiments, the system includes a chamber, a refrigeration assembly configured to cool the packaged biologic substance in the chamber, and an auxiliary heat exchanger at least partially positioned in the chamber. The auxiliary heat exchanger includes a first portion that is configured to contact at least a portion of a surface area of the packaged biologic substance. In addition, the auxiliary heat exchanger includes a second portion that is spaced from the packaged biologic substance. Further, the auxiliary heat exchanger includes a heat pipe extending between the first portion and the second portion. The heat pipe contains a refrigerant that is configured to change phase to transfer heat from the first portion to the second portion to cool the packaged biologic substance.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those having ordinary skill in the art upon reading the following detailed description, and by referring to the accompanying drawings. It should be appreciated that this disclosure may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various embodiments, reference will now be made to the accompanying drawings in which.

DETAILED DESCRIPTION

As previously described, a system for freezing or thawing a biologic substance (a "freeze/thaw system") may control the rate of temperature change of the biologic substance in order to quickly and evenly freeze or thaw the biologic substance and to prevent degradation thereof. A freeze/thaw system may use forced-air convection to change the temperature of the biologic substance; however, at least some surfaces of the biologic substance may be occluded from the airflow (e.g., such as surfaces that are engaged with a shelf or other support surface within the chamber). As a result, these occluded surface may slow and/or restrict the change in temperature of the biologic substance during operations.

Accordingly, embodiments disclosed herein may utilize one or more additional auxiliary heat exchangers that are at least partially positioned within a chamber of a freeze/thaw system to promote heat exchange with one or more surfaces of a biologic substance that may be at least partially occluded from an airflow or atmosphere within the chamber. In some embodiments, the additional auxiliary heat exchanger(s) may each include one or more heat pipes that are configured to exchange between the at least partially occluded surface(s) of the biologic substance and the airflow or another surface or atmosphere within the chamber. Thus, through use of the embodiments disclosed herein, a biologic substance may be more quickly and evenly frozen or thawed within a freeze/thaw system. As described in more detail below, the embodiments disclosed herein may be particularly useful in freeze/thaw systems that utilize forced-air convection; however, they may also be useful in freeze/thaw systems that utilize other forms of heat transfer, such as conduction, radiation, natural convection, etc.

Figure 1:
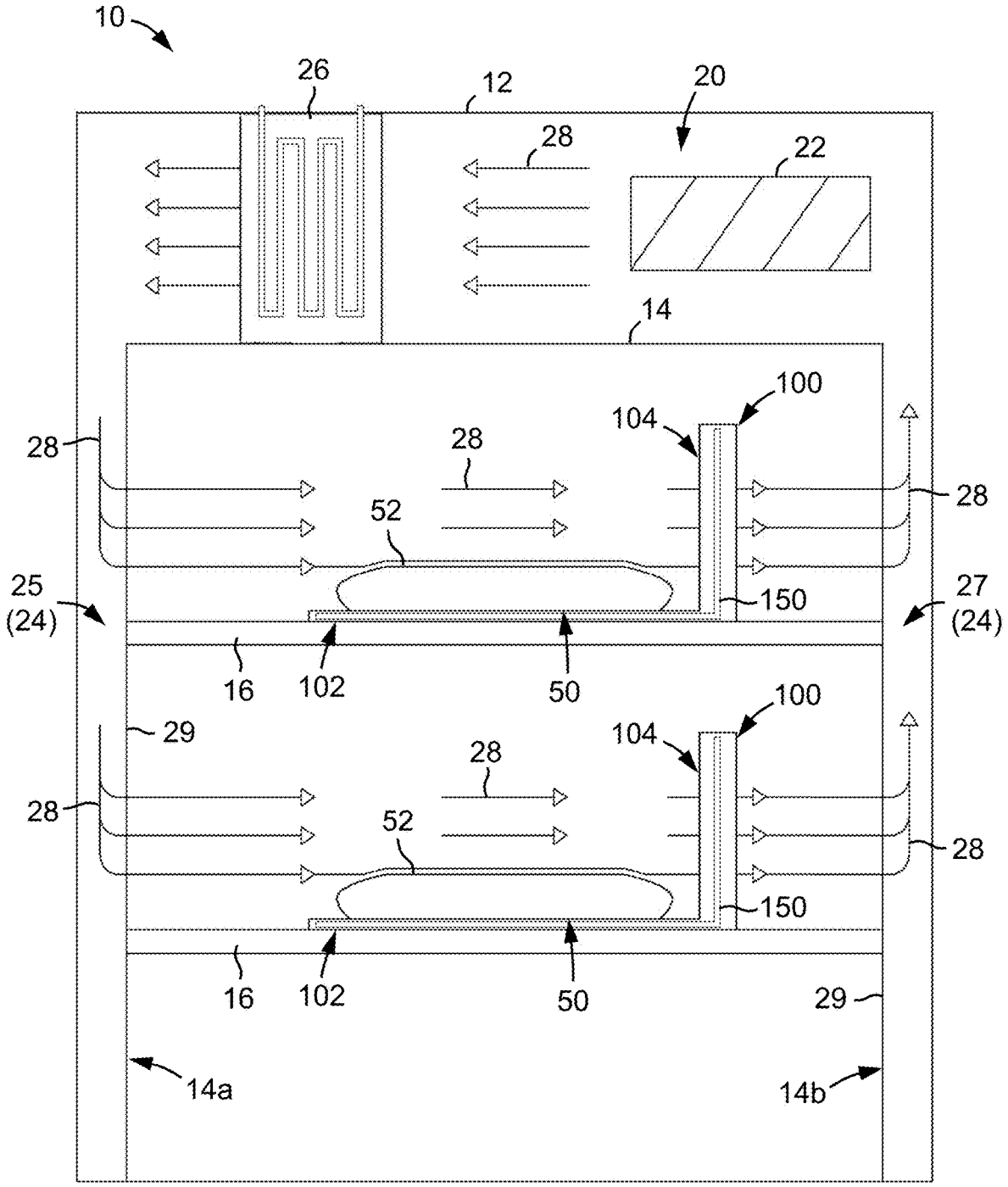
FIG. 1 is a schematic diagram of a freeze/thaw system that includes one or more auxiliary heat exchangers according to some embodiments disclosed herein.

Referring now to FIG. 1, a freeze/thaw system 10 employing one or more auxiliary heat exchangers 100 is shown according to some embodiments disclosed herein. The freeze/thaw system 10 may include a housing or cabinet 12 that defines a chamber 14 therein. One or more biologic substances 50 may be positioned in the chamber 14 on one or more shelves 16 (or other support surfaces) so that the freeze/thaw system 10 may controllably freeze or thaw the biologic substances 50 during operations.

Biologic substance 50 may include any sample or volume of biological material and/or pharmaceutical product. For instance, biologic substance 50 may include biological tissue and/or fluids as well as vaccines, medicines, or components thereof. In some instances, biologic substance 50 may include a sample of organisms, such as bacterial, viruses, microscopic organisms, etc. While embodiments disclosed herein are primarily described for use in freezing or thawing a biologic substance, it should be appreciated that various embodiments may be used to freeze or thaw a substance that may not qualify as a "biologic substance," as described herein.

The biologic substances 50 may be contained and protected in packaging or other containers. For instance, the biologic substances 50 shown in FIG. 1 are each shown to be positioned in a corresponding bag 52 (e.g., a polymer bag); however, additional containers or packaging may be placed about the bag 52 to further protect the biologic substance 50 or bag 52 from damage (including, for instance, preventing a puncture of the bag 52). For example, in some specific examples (as is described in more detail herein) a protective shell (not shown in FIG. 1, but see shell 200 shown in FIGS. 8 and 9) may be placed about the bag 52 to further protect the bag 52 and biologic substance 50 during operations. Therefore, the phrase "packaged biologic substance" may be used herein (including in the claims) to refer to a biologic substance (e.g., biologic substance 50) and any additional packaging (or containers) that is disposed about the biologic substance 50, including a bag (e.g., bag 52) and any additional packaging (such as a shell) that is placed about the bag. Moreover, the packaging of a "packaged biologic substance" may also include additional packaging types or systems, other than the above-noted bags and shells. For instance, packaging of a "packaged biologic substance" may include carboys, vials, bottles, racks, boxes, and crates, among others. Accordingly, the biologic substance(s) 50 may be referred to herein as "packaged biologic substances" 50, and an object that engages or contacts a packaged biologic substance 50 may be engaged or contacted with an outer surface of a packaging or container (e.g., bag 52, shell 200, or another packaging or container as described above) that is surrounding the biologic substance itself.

In addition, the freeze/thaw system 10 includes one or more refrigeration assemblies 20 that are operably coupled to the chamber 14. Specifically, the freeze/thaw system 10 may include a refrigeration assembly 20 that is configured to achieve and/or maintain a desired temperature (or temperature range) within the chamber 14 via forced-air convection (or more simply "forced convection") during operations. In some embodiments, the refrigeration assembly 20 may be configured to achieve and/or maintain a low temperature (e.g., such as a temperature below freezing) within the chamber 14 to thereby freeze the packaged biologic substances 50 in the chamber 14. In addition, in some embodiments, the refrigeration assembly 20 may be configured to achieve and/or maintain a higher temperature (e.g., such as a temperature above freezing) within the chamber 14 to thereby thaw a frozen packaged biologic substances 50.

Specifically, the refrigeration assembly 20 may include a blower 22 that induces an airflow 28 over a coil bank 26. A heat transfer fluid may circulate through the coil bank 26 at a temperature suitable to change the temperature of the airflow 28 as it flows over and through the coil bank 26 to ultimately facilitate freezing or thawing of the packaged biologic substance(s) 50. In some embodiments, the coil bank 26 may circulate the heat transfer fluid after it has been vaporized (or evaporated) via a suitable expander or other component, so that the coil bank 26 may comprise an "evaporator coil" (or "evaporator") of the refrigeration assembly 20. In some embodiments, the refrigeration assembly 20 may control the temperature of the coil bank 26 by, for instance, adjusting the flow of heat transfer fluid therethrough.

In some embodiments, one or more additional heating coils, such as electrically resistive coils, (not shown) may be installed upstream, downstream, and/or integral with the coil bank 26 and may heat (or increase the temperature of) the airflow 28 (e.g., such as when thawing the packaged biologic substances 50). Alternatively or additionally, in some embodiments, the coil bank 26 may condense the heat transfer fluid (e.g., such as when thawing the packaged biologic substances 50) so that the coil bank 26 may comprise a "condenser coil" (or "condenser") of the refrigeration assembly 20 (and such that the refrigeration assembly 20 may operate as a so-called "heat pump").

After the airflow 28 progresses over and/or through the coil bank 26, the airflow 28 (which may either be cooled or heated by coil bank 26 as appropriate) may then be directed through ducting 24 defined in and/or by the housing 12 so that the airflow 28 may be circulated between the refrigeration assembly 20 and chamber 14 to lower or increase temperature within chamber 14 during operations. For instance, in some embodiments, the ducting 24 may define one or more manifolds that extend vertically along one or more side walls of the chamber 14. In particular, in some embodiments, the ducting 24 may include a first or inlet manifold 25 positioned on a first side 14*a* of the chamber 14, and a second or outlet manifold 27 positioned on a second side 14*b* of the chamber 14, the second side 14*b* being opposite the first side 14*a*. The first side 14*a* and second side 14*b* may include or be defined by perforated walls 29 that allow the airflow 28 to progress from the inlet manifold 25, through the chamber 14, and into the outlet manifold 27. Airflow 28 collected in the outlet manifold 27 is directed back to the blower 22 to restart the circulation of the airflow 28 between the refrigeration assembly 20 and chamber 14 as previously described.

In some embodiments, the heat transfer fluid circulated through the coil bank 26 may comprise one or more refrigerants that may comprise hydrofluorocarbons (HFCs), chlorofluorocarbons (CFCs), hydrochlorofluorocarbons (HCFCs), fluorocarbons (FCs), hydrocarbons (HCs), Ammonia ($NH_3$), carbon dioxide ($CO_2$), or some combination thereof. In addition, it should be appreciated that the refrigeration assemblies 20 may include additional components for the circulation and handling of the heat transfer fluid, such as, for instance, one or more compressor(s), valves, expanders, tubing, condensers. Thus, the refrigeration assembly 20 may define one or more complete refrigeration cycles for the heat transfer fluid. These additional components are not shown in FIG. 1 so as to simplify the drawings and the corresponding description.

In some embodiments, the refrigeration assembly 20 may comprise a so-called cascade refrigeration system, wherein multiple refrigeration cycles are defined therein to control (e.g., lower) the temperature of the heat transfer fluid circulated through the coil bank 26 and therefore also the airflow 28 during operations. Thus, in some embodiments, the refrigeration assembly 20 may comprise multiple refrigeration cycles (some of which may employ different refrigerants therein and/or different cycle types).

As shown in FIG. 1, as the airflow 28 progresses through the chamber 14, it may flow along and around each of the packaged biologic substances 50 so as to exchange heat therewith. Thus, the airflow 28 may change a temperature of the packaged biologic substance 50 via forced convection.

However, one or more surfaces of the packaged biologic substances 50 may be occluded from the airflow 28. For instance, a bottom surface of each of the packaged biological substances 50 may be engaged with a shelf 16 or other support surface within the chamber 14 so that airflow 28 may not access these surfaces during operations. Accordingly, one or more auxiliary heat exchangers 100 may be at least partially positioned in the chamber 14 and engaged with the packaged biologic substances 50 so as to facilitate heat transfer between the airflow 28 and the one or more occluded surfaces of the packaged biologic substances 50 during operations.

Figure 2:
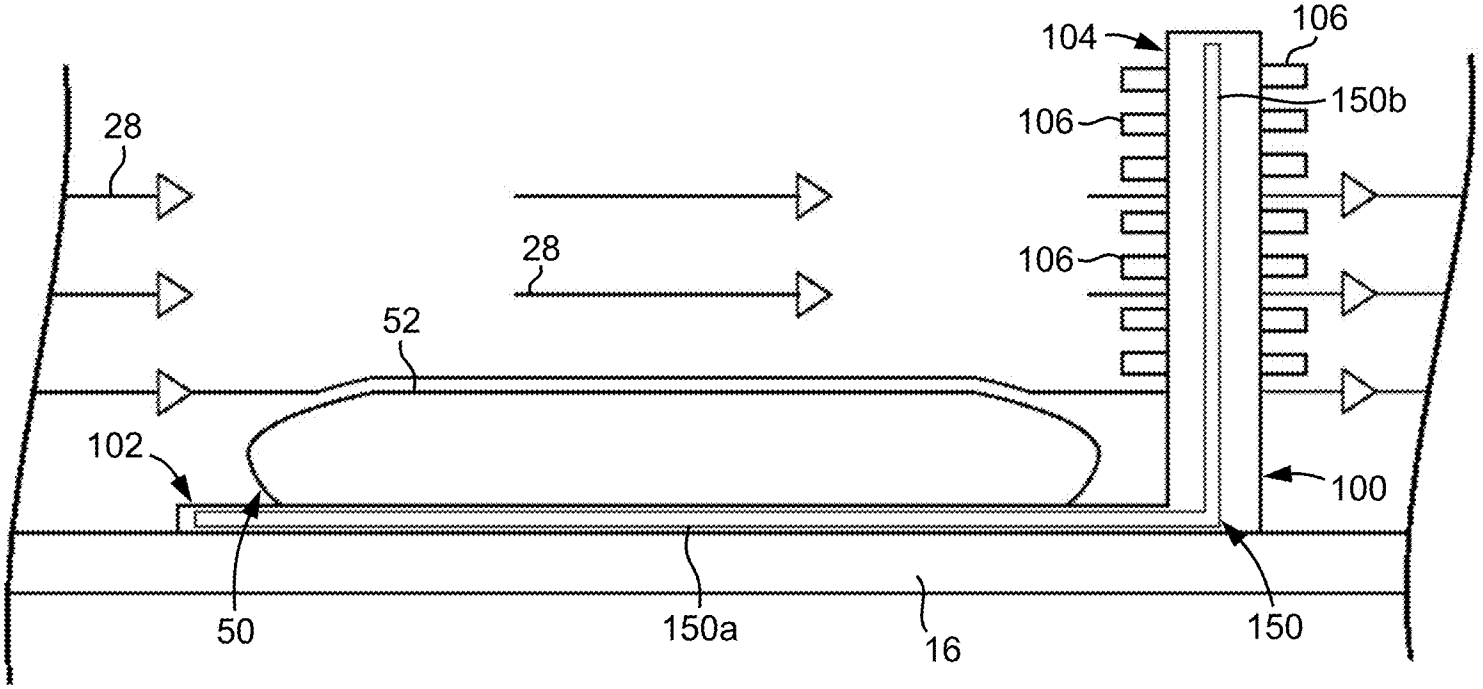
FIG. 2 is an enlarged view of one of the heat exchangers of the freeze/thaw system of FIG. 1 according to some embodiments disclosed herein.

Referring now to FIG. 2, one of the packaged biologic substances 50 and the corresponding auxiliary heat exchanger 100 is shown within the chamber 14 according to some embodiments. The auxiliary heat exchanger 100 (or more simply "heat exchanger 100") may include a first portion 102 and a second portion 104.

The first portion 102 may engage with an outer surface of the packaged biologic substance 50, and particularly may engage with and contact the occluded, bottom surface of the bag 52 of packaged biologic substance 50. As a result, the first portion 102 of the heat exchanger 100 may underly the packaged biologic substance 50 on the corresponding shelf 16 within chamber 14.

The second portion 104 of the heat exchanger 100 may extend outward and away from the first portion 102 at a substantially non-zero angle relative to first portion 102 so that the second portion 104 may be exposed to the airflow 28. For instance, in some embodiments (such as the embodiment shown in FIG. 2), the first portion 102 and the second portion 104 may each extend linearly, and may be oriented at approximately 90° to one another. Thus, because the first portion 102 underlies the packaged biologic substance 50 along the corresponding shelf 16, the second portion 104 may be spaced from the packaged biologic substance 50 and may particularly extend vertically upward from and above the first portion 102, shelf 16, and packaged biologic substance 50 to thereby expose the second portion 104 to the airflow 28. The second portion 104 may include an enhanced or increased surface area so as to promote heat transfer between the airflow 28 and second portion 104 during operations. For instance, in some embodiments, the second portion 104 may include one or more (e.g., a plurality of) fins 106, such as, for instance, pin fins, plate fins, rectangular fins, spine fins, annular pins, helical fins, etc.

In addition, the heat exchanger 100 may include one or more heat pipes 150 that extend between the first portion 102 and the second portion 104. In particular, the one or more heat pipes 150 may be embedded within the material(s) making up the heat exchanger 100. For instance, in some embodiments, the first portion 102 and second portion 104 may at least partially comprise a metallic material, and the heat pipe(s) 150 may be at least partially embedded or integrally formed in the metallic material of the heat exchanger 100 (e.g., by drilling, welding, etc.). In some embodiments, the one or more heat pipes 150 may be attached to an outer surface of the first portion 102 and/or the second portion 104 of heat exchanger 100. Each of the one or more heat pipes 150 includes a first portion 150*a* that is positioned on or in the first portion 102 of the heat exchanger 100, and a second portion 150*b* that is positioned on or in the second portion 104 of the heat exchanger 100.

As will be described in more detail below, the one or more heat pipes 150 may be configured to transfer heat between the first portion 150*a* and second portion 150*b* (and thus also the first portion 102 and second portion 104 of the heat exchanger 100), depending on the temperature differences between the packaged biologic substance 50 and the airflow 28 during a freezing or thawing operation utilizing system 10. Each of the one or more heat pipes 150 (one heat pipe is schematically shown in FIG. 2) may comprise a sealed or closed elongate tube or chamber that contains a volume of heat transfer fluid therein. The heat transfer fluid in the one or more heat pipes 150 may comprise a refrigerant or a combination of refrigerants, such as any one or more of the refrigerants listed above for the refrigeration assembly 20.

During operations, one of the portions 150*a*, 150*b* of the heat pipe 150 may be in thermal contact (e.g., either via direct or indirect engagement) with a heat source (e.g., either the packaged biologic substance 50 or the airflow 28) while the other portion 150*a*, 150*b* of the heat pipe 150 may be in thermal contact (e.g., again via direct or indirect engagement) with a heat sink (e.g., the other of the packaged biologic substance 50 or the airflow 28). The heat source may sufficiently heat the heat transfer fluid within the corresponding portion 150*a*, 150*b* of the heat pipe 150 to thereby vaporize the heat transfer fluid and facilitate migration of the vaporized heat transfer fluid to the other portion 150*a*, 150*b* of the heat pipe 150 to thereby transfer heat to the heat sink.

Specifically, when the freeze/thaw system 10 is operating to freeze a package biologic substance 50, the temperature airflow 28 may be lower than the temperature of the packaged biologic substance 50. As a result, the packaged biologic substance 50 may comprise the "heat source" that transfers (e.g., conducts) heat to the first portion 150*a* of heat pipe 150 so as to vaporize the heat transfer fluid therein. The vaporized heat transfer fluid may then migrate along the heat pipe 150 to the second portion 150*b*, so as to transfer heat to the second portion 104 and ultimately the airflow 28. As a result of the heat loss to the airflow 28, the heat transfer fluid in the second portion 150*b* of the heat pipe 150 may condense, and then flow (e.g., via capillary forces, wicking, pressure, gravity, etc.) back to the first portion 150*a* portion to reinitiate the above-described sequence.

Conversely, when the freeze/thaw system 10 is operating to thaw the packaged biologic substance 50, the temperature of the airflow 28 may be higher than the temperature of the packaged biologic substance 50. As a result, the airflow 28 may comprise the "heat source" that transfers heat to the second portion 150*b* of heat pipe 150 so as to vaporize the heat transfer fluid therein. The vaporized heat transfer fluid may then migrate along the heat pipe 150 to the first portion 150*a*, so as to transfer heat to the first portion 102 and ultimately the packaged biologic substance 50. As a result of the heat loss to the packaged biologic substance 50, the heat transfer fluid in the first portion 150*a* of the heat pipe 150 may condense, and then flow (e.g., via capillary forces, wicking, pressure, gravity, etc.) back to the second portion 150*b* portion to reinitiate the above-described sequence.

Thus, both when the freeze/thaw system 10 is freezing and thawing the packaged biologic substance 50, the heat exchanger 100 may facilitate heat transfer from the surfaces of packaged biologic substance 50 that are generally occluded from the airflow 28 (including surfaces of the bag 52 or another outer container or packaging). As a result, the heat exchanger 100 may, in effect, increase the surface area of the packaged biologic substance 50 that is thermally exposed to the airflow 28 during operations. Therefore, the heat exchanger 100 may promote a faster, more even, and more efficient temperature change of the packaged biologic substance 50 during freezing and thawing operations utilizing system 10. Further details of embodiments of heat exchanger 100 and the one or more heat pipes 150 thereof are described below.

As previously described, the one or more of the heat pipes 150 in each of the heat exchangers 100 of system 10 (FIG. 1) may have a number of configurations and designs according to various embodiments. For instance, FIG. 3 shows an embodiment of heat exchanger 100 that schematically illustrates a single heat pipe 150 positioned therein that is configured as a so-called wicked heat pipe.

Figure 3:
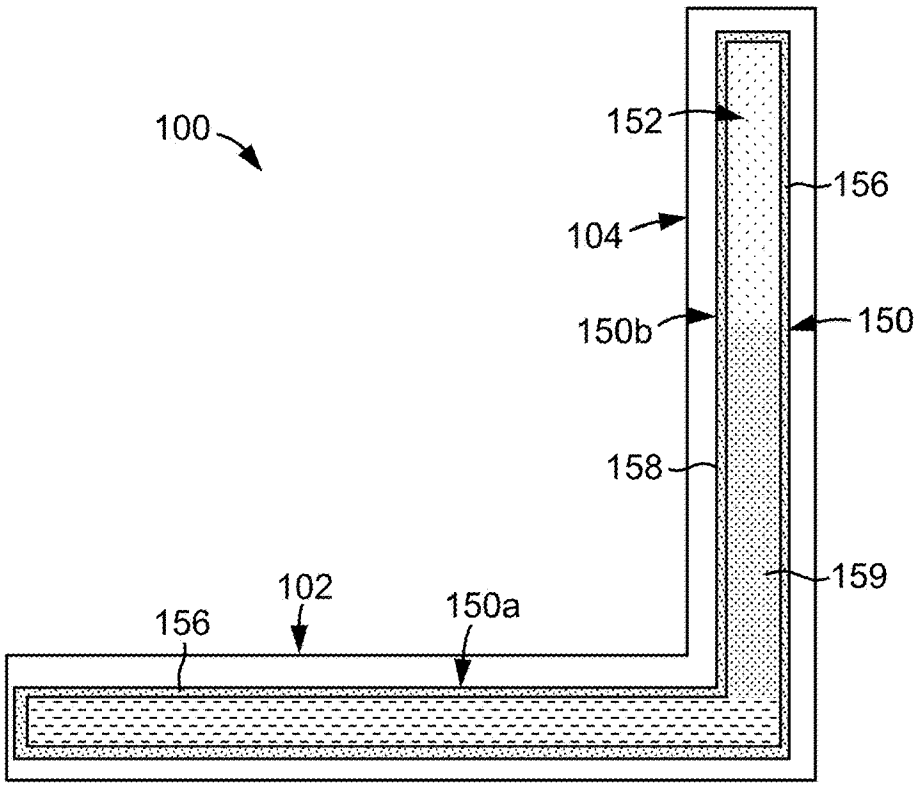
FIG. 3 is a schematic view of an auxiliary heat exchanger for use within a freeze/thaw system according to some embodiments disclosed herein.

In particular, the heat pipe 150 shown in FIG. 3 may include an outer wall 158 that defines an inner chamber 152. The inner chamber 152 may contain the heat transfer fluid 159 as previously described. A layer of wicking material 156 (e.g., such as a body that includes a plurality of grooves, a screen structure, a sintered powder, or other structure that defines a plurality of capillary flow paths therethrough) may be positioned along the inner surface of the outer wall 158 so that the wicking material 156 at least partially surrounds or bounds the inner chamber 152 and the heat transfer material therein. In some embodiments, an additional inner wall (not shown) may be positioned in the inner chamber 152 to separate or contain the wicking material 156. In some of these embodiments, the inner wall (not shown) may be porous or perforated so that the heat transfer fluid may access the wicking material 156 during operations.

During operations, heat may vaporize the heat transfer fluid 159 positioned in the inner chamber 152 at either the first portion 150*a* or the second portion 150*b* as previously described. For instance, in the illustration of FIG. 3, the heat transfer fluid 159 in the first portion 150*a* of the heat pipe 150 is heated and therefore vaporized. The vaporized heat transfer fluid 159 then flows to the second portion 150*b* and cools so as to condense back into a liquid. The condensed heat transfer fluid 159 may penetrate into the wicking material 156 and wick back from the second portion 150*b* to the first portion 150*a* along the capillary flow paths defined therein to thereby re-vaporize and restart the heat transfer process.

Figure 4:
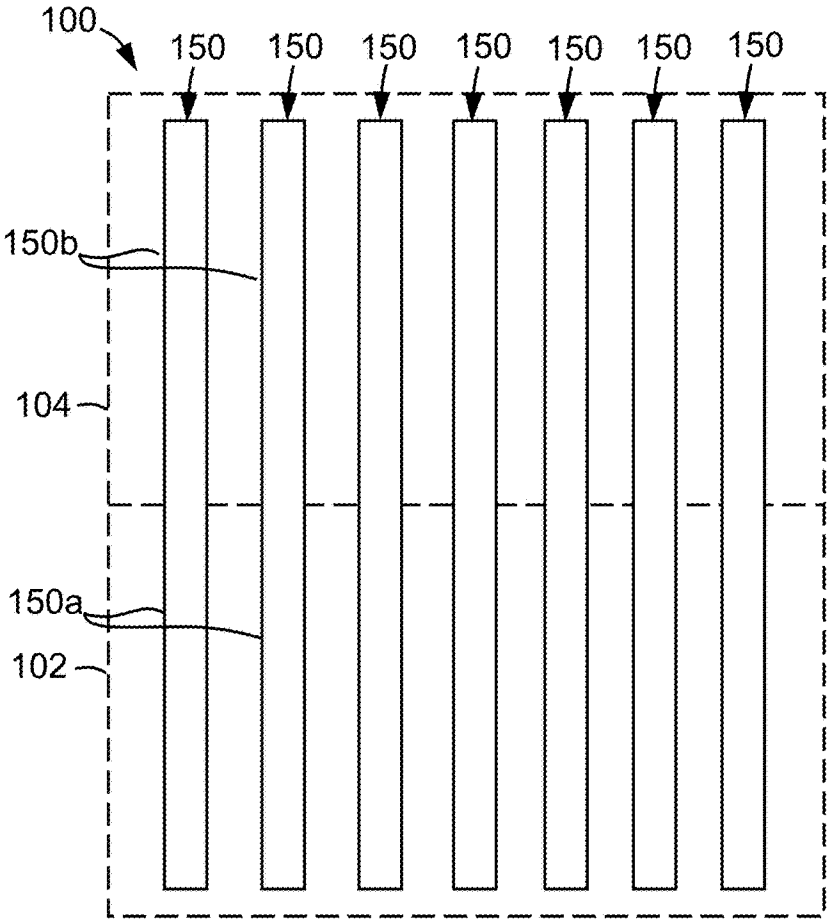
FIG. 4 is a schematic view of an auxiliary heat exchanger for use within a freeze/thaw system according to some embodiments disclosed herein.

Referring now to FIG. 4, as previously described, in some embodiments each heat exchanger 100 (or at least one of the heat exchangers 100) may include a plurality of heat pipes 150. In some embodiments, each of the plurality of heat pipes 150 of a heat exchanger 100 may be configured the same. For instance, in some embodiments, each of the heat pipes 150 may be configured as a wicked heat pipe as shown in FIG. 3 and previously described, and may include the same heat transfer fluid (e.g., heat transfer fluid 159) at the same or a similar charge. The "charge" of heat transfer fluid in a heat pipe (heat pipe(s) 150) may refer to the mass (e.g., in grams, or other suitable mass units) of heat transfer fluid that is contained in the heat pipe.

Conversely, in some embodiments, a heat exchanger 100 for use within the freeze/thaw system 10 may comprise a plurality of heat pipes 150, wherein one of more of the heat pipes 150 are configured differently. For instance, in some embodiments, a heat exchanger 100 may include a plurality of heat pipes 150, wherein the plurality of heat pipes 150 may be configured to transfer heat between the portions 150*a*, 150*b* over different temperature ranges for the corresponding heat source and/or heat sink. In some embodiments, the different temperature ranges may at least partially overlap.

For instance, in some embodiments, the plurality of heat pipes 150 may be configured so that one or more first heat pipes 150 of the plurality of heat pipes 150 most efficiently transfer heat between the portions 150*a*, 150*b* over a first temperature range for the heat source/sink, one or more second heat pipes 150 of the plurality of heat pipes 150 most efficiently transfer heat between the portions 150*a*, 150*b* over a second temperature range for the heat source/sink, one or more third heat pipes 150 of the plurality of heat pipes 150 most efficiently transfer heat between the portions 150*a*, 150*b* over a third temperature range for the heat source/sink, and so on. In some embodiments, the first temperature range, second temperature range, third temperature range, etc. may at least partially overlap, so that at least one heat pipe 150 of the plurality of heat pipes 150 may be efficiently transferring heat between the portions 150*a*, 150*b* when freezing or thawing a packaged biologic substance 50 using the system 10.

Each heat pipe 150 may transfer heat between the portions 150*a*, 150*b* when the temperatures of the heat sink and heat source (which may each either comprise the packaged biologic substance 50 or the airflow 28 as previously described) are below and above, respectively, the phase change temperature of the heat transfer fluid therein. The phase change temperature of the heat transfer fluid may be selected or adjusted within a heat pipe 150 by adjusting one or more of the type or mixture of heat transfer fluid, the charge of heat transfer fluid in the heat pipe 150, the volume of the heat transfer fluid, the pressure of the heat transfer fluid, the design of the heat pipe 150, etc. Thus, during operations, when the temperatures of the heat sink and heat source both decrease below, or both increase above the phase change temperature of the heat transfer fluid contained in the heat pipe 150, the heat transfer fluid may remain as a single phase (e.g., either gas or liquid) and may no longer transfer heat between the portions 150*a*, 150*b* via the vaporization and condensation of the heat transfer fluid as previously described.

Referring again to FIGS. 1 and 2, in some examples, the system 10 (including heat exchangers 100) may be used to freeze one or more packaged biologic substances 50. During this process, the temperature of the airflow 28 within chamber 14 may be colder than the temperature of the packaged biologic substance 50. Consideration will be given to the operation of one of the heat exchangers 100 under this circumstance to simplify the following explanation.

Specifically, during a freezing operation within the system 100, the packaged biologic substance 50 acts as the heat source, and the airflow 28 acts as the heat sink. Accordingly, the heat transfer fluid contained in the heat pipe(s) 150 of heat exchanger 100 may vaporize in the first portion 150*a* (in contact with the packaged biologic substance 50) and migrate to the second portion 150*b* (in contact with the airflow 28) to thereby condense and flow back to the first portion 150*a* as previously described.

This process of vaporization and condensation of the heat transfer fluid may occur as long as the temperature of the airflow 28 (heat sink) is below the phase-change temperature of the heat transfer fluid (e.g., such as the condensation temperature, vaporization temperature, etc.) and the temperature of the packaged biologic substance 50 is above the phase change temperature. However, the vaporization and condensation process within a heat pipe 150 may be most efficient over a subset range of temperature differences between the heat source and heat sink. Thus, during the above noted freezing operation, the heat pipe 150 may more (or most) completely vaporize and condense the heat transfer fluid over the subset range of temperature differences between the packaged biologic substance 50 and airflow 28, but then may gradually vaporize less and less of the heat transfer fluid as the temperature of the packaged biologic substance 50 decreases toward the phase change temperature of the heat transfer fluid. Eventually the temperature of the packaged biologic substance 50 may fall below the phase change temperature of the heat transfer fluid contained in the heat pipe 150, so that there is insufficient heat transferred from the packaged biologic substance 50 to vaporize the heat transfer fluid, and all (or substantially all) of the heat transfer fluid contained in the heat pipe 150 remains a liquid (e.g., in both the first portion 150*a* and the second portion 150*b*). From this point on, the heat pipe 150 is unable (or at least has a greatly diminished capacity) to transfer heat between the portions 150*a*, 150*b* (and thus also between the packaged biologic substance 50 and the airflow 28) via the vaporization and condensation of the heat transfer fluid therein.

Conversely, in some examples, the system 10 (including heat exchangers 100) may be used to thaw one or more frozen packaged biologic substances 50. During this process, the temperature of the airflow 28 within chamber 14 may be warmer than the temperature of the packaged biologic substance 50. Again, consideration will be given to the operation of one of the heat exchangers 100 under this circumstance to simplify the following explanation.

Specifically, during a thawing operation within the system 100, the packaged biologic substance 50 acts as the heat sink, and the airflow 28 acts as the heat source. Accordingly, the heat transfer fluid contained in the heat pipe(s) 150 of heat exchanger 100 may vaporize in the second portion 150*b* (in contact with the airflow 28) and migrate to the first portion 150*a* (in contact with the packaged biologic substance 50) to thereby condense and flow back to the second portion 150*b* as previously described.

Again, this process of vaporization and condensation of the heat transfer fluid may occur as long as the temperature of the packaged biologic substance 50 (heat sink) is below the phase-change temperature of the heat transfer fluid and the temperature of the airflow 28 is above the phase change temperature. However, as with a freezing operation, when thawing the packaged biologic substance 50 the vaporization and condensation process within a heat pipe 150 may be most efficient over a subset range of temperature differences between the heat source and heat sink. Thus, during the above-noted thawing operation, the heat pipe 150 may more (or most) completely vaporize and condense the heat transfer fluid over the subset range of temperature differences between the airflow 28 and packaged biologic substance 50, but may gradually condense less and less of the heat transfer fluid as the temperature of the packaged biologic substance 50 increases toward the phase change temperature of the heat transfer fluid. Eventually the temperature of the packaged biologic substance 50 rises above the phase change temperature of the heat transfer fluid contained in the heat pipe 150, so that all (or substantially all) of the heat transfer fluid contained in the heat pipe 150 remains a gas (e.g., in both the first portion 150*a* and the second portion 150*b*). From this point on, the heat pipe 150 is unable (or at least has a greatly diminished capacity) to transfer heat between the portions 150*a*, 150*b* (and thus also between the packaged biologic substance 50 and the airflow 28) via the vaporization and condensation of the heat transfer fluid therein.

Referring again to FIG. 4, in some embodiments a heat exchanger 100 may include a plurality of heat pipes 150, wherein one or more of the heat pipes 150 is configured to have different phase change temperatures for the heat transfer fluid contained therein. For instance, in some embodiments, one or more first heat pipes 150 of the plurality of heat pipes 150 may be configured to most efficiently (e.g., most completely) vaporize and condense the heat transfer fluid contained therein over a first temperature range of the packaged biologic substance 50, and one or more second heat pipes 150 of the plurality of heat pipes 150 is configured to most efficiently vaporize and condense the heat transfer fluid contained therein over a second temperature range of the packaged biologic substance 50, wherein the second temperature range is different from the first temperature range. In addition, the first temperature range and the second temperature range may at least partially overlap so that the heat exchanger 100 may efficiently transfer heat between the portions 102, 104 throughout a freezing or thawing operation as previously described.

In some specific examples, a first heat pipe 150 of a heat exchanger 100 may be configured to most efficiently vaporize and condense the heat transfer fluid contained therein (and thus transfer heat between the heat source and heat sink) when the packaged biologic substance 50 is above to just below freezing (e.g., above 0° C. and down to about −10° C.), and a second heat pipe 150 of the heat exchanger 100 may be configured to most efficiently vaporize and condense the heat transfer fluid contained therein (and thus transfer heat between the heat source and heat sink) when the packaged biologic substance 50 is below freezing (e.g., below 0° C., such from about 0° C. to −40° C. or lower). However, other specific configurations and effective temperature ranges of the heat pipes 150 of a heat exchanger are contemplated herein.

Without being limited to this or any other theory, by configuring a plurality of heat pipes 150 in the heat exchanger 100 to change a phase of heat transfer fluid over different temperature ranges for the packaged biologic substance 50 (or potentially the airflow 28), the heat exchanger 100 may operate to enhance heat transfer to or from the packaged biologic substance 50 throughout a freezing or thawing process. In some embodiments, the heat pipes 150 of a heat exchanger 100 may be configured (e.g., via the different phase change temperatures and/or efficiency ranges) to increase the rate of temperature change of the packaged biologic substance 50 over particular temperature ranges. For instance, in some situations, it may be desirable to freeze or thaw the packaged biologic substance 50 quickly to avoid degradation and/or spoilage. Thus, configuring the heat pipes 150 of a heat exchanger 100 to have different phase change temperatures for the heat transfer fluid therein, the heat exchanger 100 may control (such as increase) the speed or pace of the freezing or thawing process over particular temperature ranges.

In addition, in some embodiments, one or more of heat pipes 150 of a heat exchanger 100 may include a mixture of two or more refrigerants as the heat transfer fluid contained therein. The mixture of the two or more refrigerants may include a first refrigerant that is configured to change phase (or most efficiently change phase) within the heat pipe 150 over a first temperature range of the packaged biologic substance 50 and a second refrigerant that is configured to change phase (or most efficiently change phase) over a second temperature range of the packaged biologic substance 50 as previously described. Thus, during operations, when the packaged biologic substance 50 is in the first range, the first refrigerant of the heat pipe 150 may most completely change phase to transfer heat between the portion 150*a*, 150*b* as previously described, while the second refrigerant may remain at a single phase (or more substantially at a single phase). Thereafter, when the packaged biologic substance 50 is in the second temperature range, the second refrigerant may most completely change phase to transfer heat between the portions 150*a*, 150*b* as previously described, while the first refrigerant may remain at a single phase (or more substantially at a single phase). Thus, in these embodiments, a single heat pipe 150 may be configured to transfer heat between the portions 150*a*, 150*b* over a plurality of temperature ranges for the packaged biologic substance 50.

Figure 5:
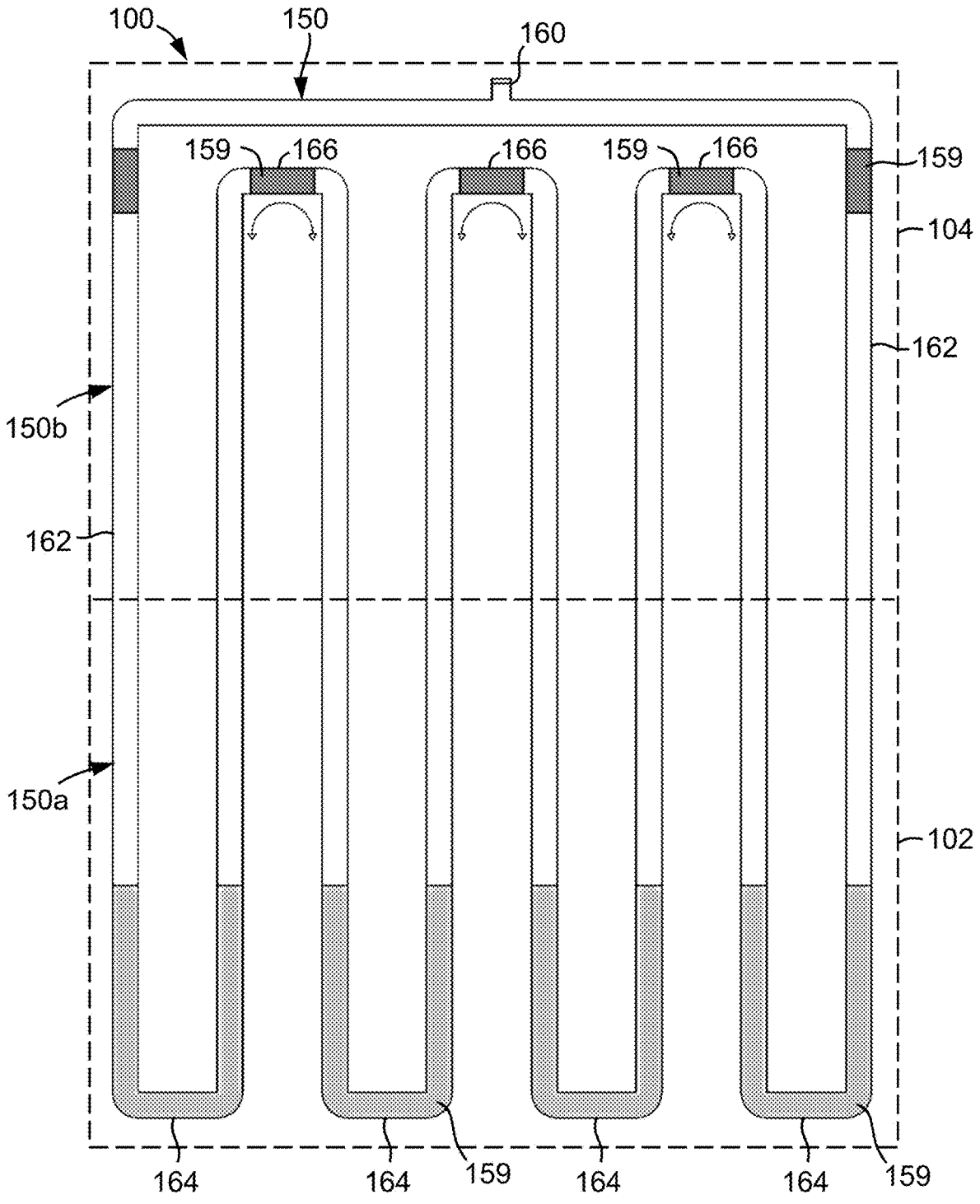
FIG. 5 is a schematic view of another auxiliary heat exchanger for use within a freeze/thaw system according to some embodiments disclosed herein.

FIG. 5 shows an embodiment of a heat pipe 150 positioned in a heat exchanger 100 that is configured as a so-called "slugging heat pipe." In particular, the heat pipe 150 of FIG. 5 includes a continuous, serpentine tube that oscillated between the first portion 102 and second portion 104 of the heat exchanger 100. The heat pipe 150 may include a sealable inlet 154 that may be generally positioned in the second portion 104 (although, inlet 154 may be positioned at any particular location in heat exchanger 100). The inlet 154 leads into a T-intersection with a pair of branched lines 162 extending from the inlet 160 to the first portion 102 of the heat exchanger 100. Opposite the inlet 154, the branched lines 162 are connected by a plurality of alternating bends 164, 166 that route the heat pipe 150 back and forth between the first portion 102 and second portion 104. Specifically, each of the first bends 164 may be positioned in the first portion, whereas each of the second bends 166 are positioned in the second portion 104. Heat transfer fluid 159 (which may comprise one or a combination of refrigerants as described herein) may be injected into the heat pipe 150 via the inlet 160, and the inlet 160 may then be closed so as to seal the heat transfer fluid 159 therein.

During operations, heat may be applied to either the first bends 164 or the second bends 166. In particular, during a freezing operation using freeze/thaw system 10, the first portion 102 of heat exchanger 100 (which is in contact with the packaged biologic substance 50 as previously described) may receive heat energy that is transferred to the second portion 104 (which is exposed to airflow 28 as previously described) via heat pipe 150. Thus, heat from the packaged biologic substance 50 may vaporize heat transfer fluid that is positioned in the first bends 164 so that the vaporized heat transfer fluid may migrate toward the second bends 166 and into the branched lines 162 positioned in the second portion 104. Once the heat transfer fluid reaches the second bends 166 and the portions of the branched lines 162 in the second portion 104, the heat transfer fluid may condense into a liquid that migrates back toward the first bends 164. Due to the continuous, serpentine shape of the heat pipe 150 of FIG. 5, vaporized heat transfer fluid is continuously migrated from the first bends 164 toward to second bends 166 so as to segregate the condensed, liquid heat transfer fluid into slugs that migrate back toward the first bends 164.

During a thawing operation using freeze/thaw system 10 (wherein the first portion 102 of heat exchanger 100 is in contact with the packaged biologic substance 50 as the heat sink, and the second portion 104 is in contact with the airflow 28 as the heat source), the flow of heat transfer fluid may be reversed from that described above. Specifically, the heat transfer fluid may vaporize in the second bends 166, migrate toward the first bends 164, and then condense and flow back to the second bends 166 via slugged flow as previously described.

Figure 6:
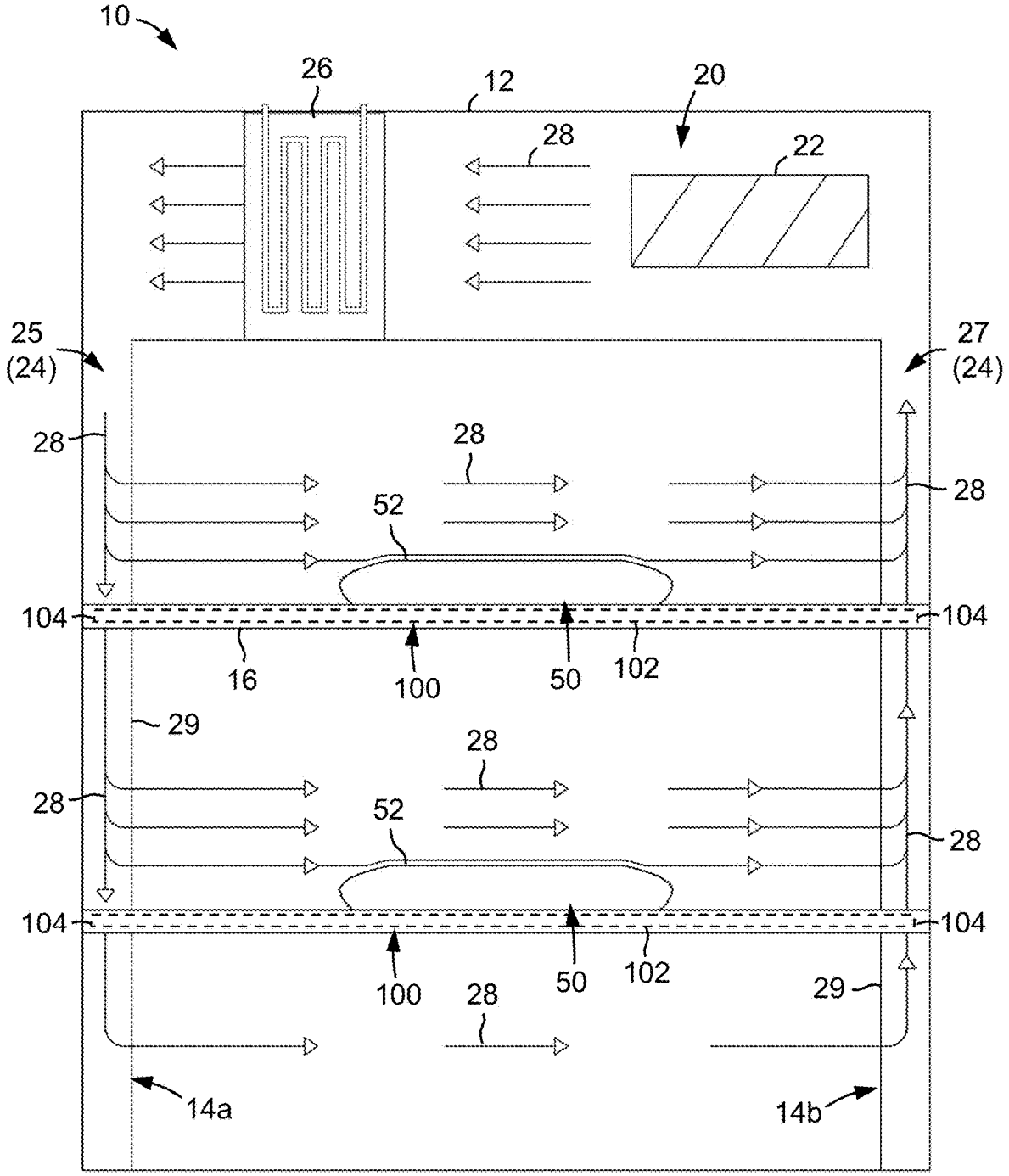
FIG. 6 is a schematic diagram of a freeze/thaw system that includes one or more auxiliary heat exchangers according to some embodiments disclosed herein.

Referring now to FIG. 6, in some embodiments, one or more of the heat exchangers 100 of the freeze/thaw system 10 may be at least partially integrated into one or more of the shelves 16 that support the packaged biologic substances 50 within chamber 14. For example, as shown in FIG. 6, a heat exchanger 100 may be integrally formed within each of the shelves 16 so that the first portion 102 of the heat exchanger 100 is positioned in the chamber 14 and underlies and supports the packaged biologic substance 50 as the shelf 16, and the second portion 104 of the heat exchanger 100 is at least partially positioned in the ducting 24 so as to be exposed to the airflow 28. In the embodiment illustrated in FIG. 6, each heat exchanger 100 may include a pair of second portions 104, wherein each second portion 104 is at least partially inserted within one of the inlet manifold 25 or the outlet manifold 27, through the corresponding perforated walls 29. In some embodiments, the heat exchangers 100 integrated within the shelves 16 may include a single second portion 104 that is at least partially inserted within one of the inlet manifold 25 or the outlet manifold 27.

Figure 7:
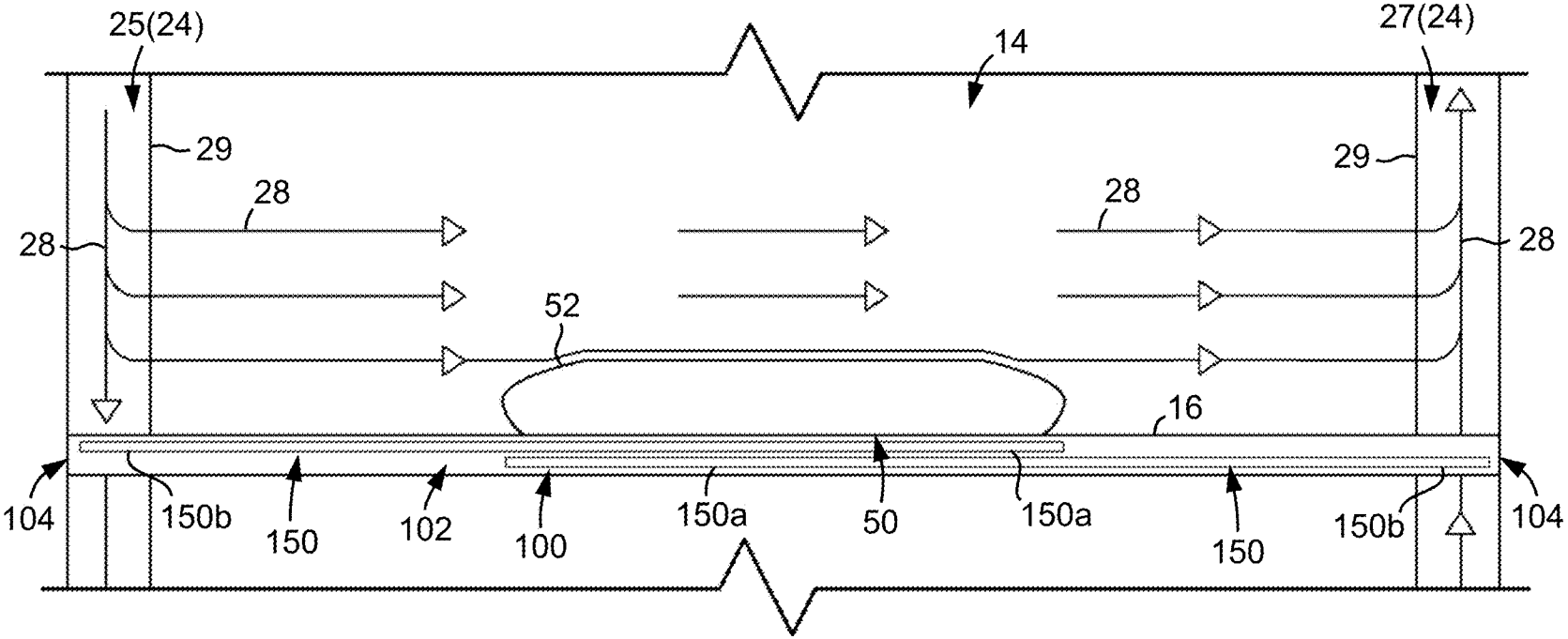
FIG. 7 is an enlarged view of one of the heat exchangers of the freeze/thaw system of FIG. 6 according to some embodiments disclosed herein.

Referring now to FIG. 7, one of the heat exchangers 100 of the system 10 shown in FIG. 6 is shown in greater detail. In particular, the heat exchanger 100 shown in FIG. 7 is integrated into the shelf 16 that is supporting the packaged biologic substance 50 and includes a plurality of heat pipes 150 positioned therein. At least one of the plurality of heat pipes 150 has a first portion 150*a* that is positioned in the chamber 14 and is integrated with the portion of the shelf 16 that underlies the packaged biologic substance 50, and a second portion 150*b* that is at least partially positioned in the inlet manifold 25. In addition, at least another of the plurality of heat pipes 150 in the heat exchanger 100 of FIG. 7 has a first portion 150*a* that is positioned in the chamber 14 and is integrated with the portion of the shelf 16 that underlies the packaged biologic substance 50, and a second portion 150*b* that is at least partially positioned in the outlet manifold 27. Thus, the first portions 150*a* of the heat pipes 150 may be engaged with the packaged biologic substance 50 and the second portions 150*b* of the heat pipes 150 may be exposed to the airflow 28 in either the inlet manifold 25 or outlet manifold 27. As a result, during operations, the heat pipes 150 may transfer heat between the packaged biologic substance 50 in the chamber 14 and the airflow 28 in one or both of the manifolds 25, 27 so as to freeze or thaw the packaged biologic substance 50 as previously described.

The heat pipes 150 of FIG. 7 may be configured according to any of the example heat pipes described herein. In addition, in some embodiments, the heat pipes 150 may be configured to change a phase of the heat transfer fluid contained therein over different temperature ranges of the packaged biologic substance 50 or the airflow 28 as previously described. In some embodiments, the heat exchanger 100 may include one or more heat pipes 150 that each have a second portion 150*b* that is at least partially inserted into one of the inlet manifold or the outlet manifold 27. In addition, in some embodiments, the second portion(s) 104 of the heat exchangers 100 may have one or more fins (e.g., fins 106 shown in FIG. 2) that are positioned in the inlet manifold 25 or outlet manifold 27.

Figure 8:
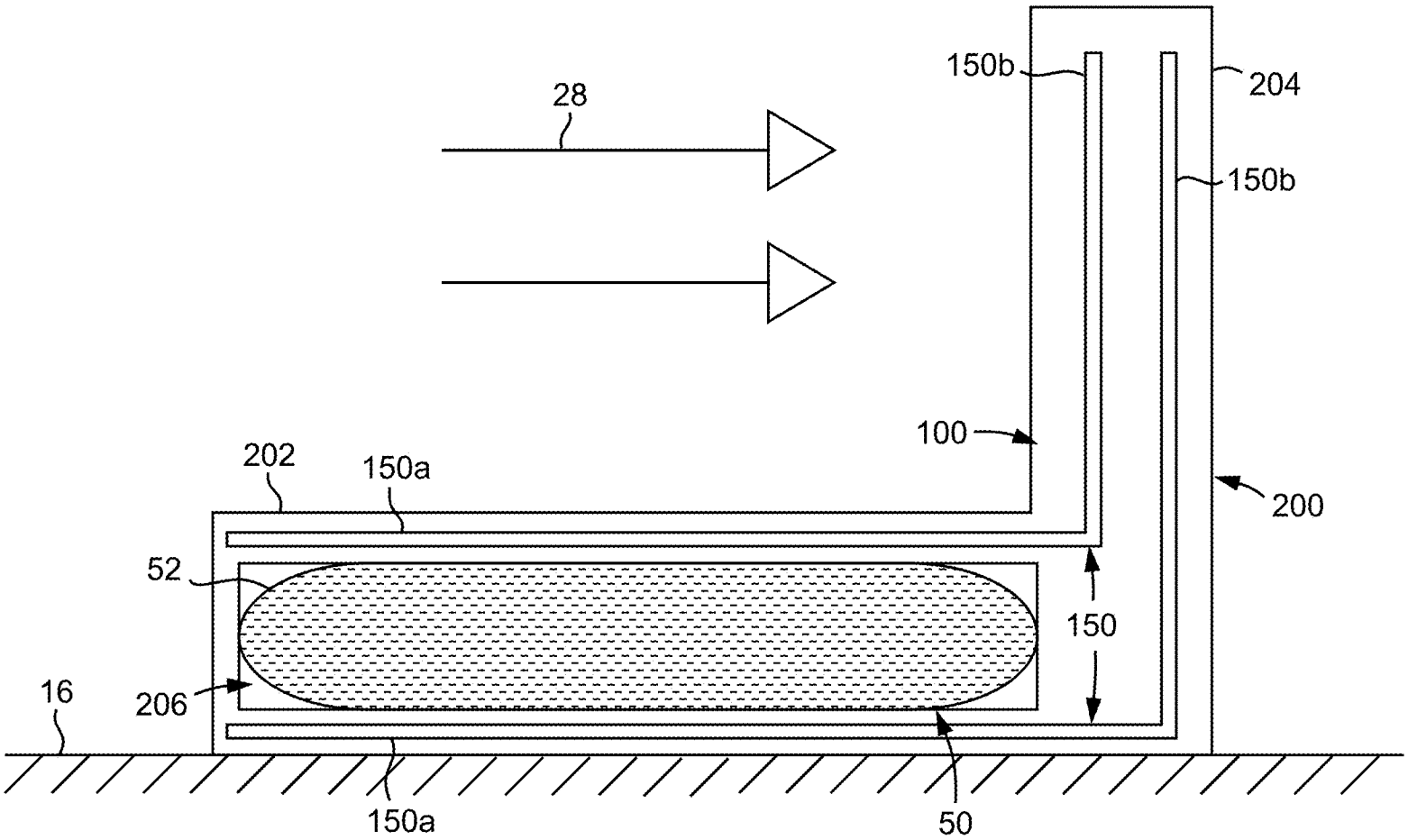
FIGS. 8 and 9 are enlarged views of an auxiliary heat exchanger integrated within a shell of a packaged biologic substance according to some embodiments disclosed herein.
Figure 9:
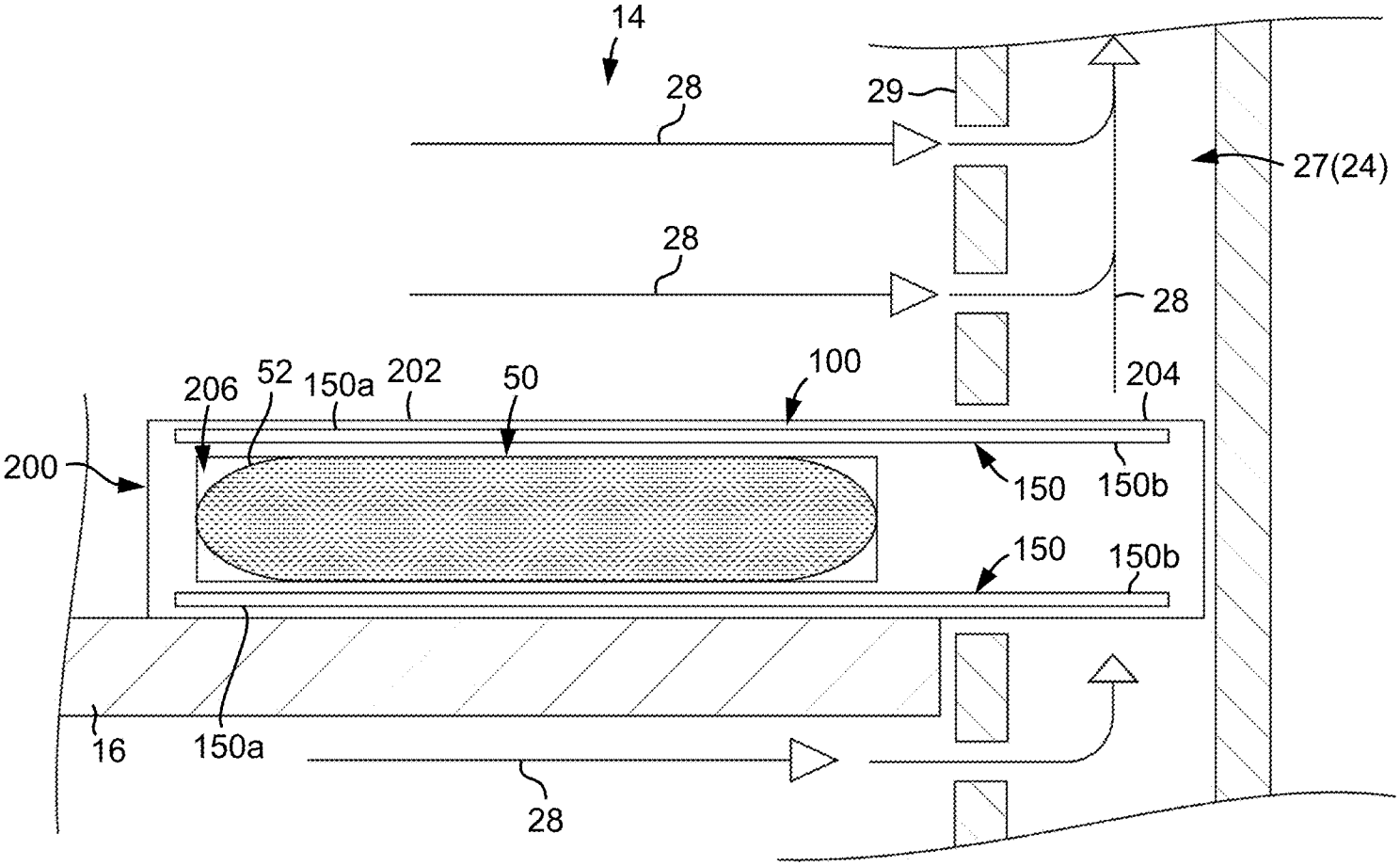

Referring now to FIGS. 8 and 9, as previously described, the packaged biologic substance 50 may include a protective shell 200 that surrounds the bag 52 so as to provide additional protection from damage. The shell 200 may comprise a rigid material, such as a polymer or a metal. While the shell 200 may provide additional protection for the bag 52, it may also occlude additional surfaces of the bag 52 from the airflow 28, and may therefore restrict heat exchanger between the packaged biologic substance 50 and the airflow 28 during operations. Thus, in some embodiments, the heat exchanger 100 may be integrated with the shell 200 so as to enhance heat transfer between the packaged biologic substance 50 and the airflow 28 during operations.

The heat exchanger 100 may be defined by one or more heat pipes 150 that are embedded or positioned within the walls or body of the shell 200. The shell 200 may thus include a first portion 202 that defines a chamber or enclosure 206 that receives and at least partially encloses the bag 52 therein, and a second portion 204 that is exposed to the airflow 28. The one or more heat pipes 150 embedded or coupled to the walls of the shell 200 may extend between the first portion 202 and the second portion 204 so as to transfer heat between the packaged biologic substance 50 and the airflow 28 as previously described. Specifically, each heat pipe 150 may include a first portion 150*a* positioned in the first portion 202 of shell 200, and a second portion 150*b* positioned in the second portion 204 of shell 200. The heat pipes 150 may be configured similar to any other example heat pipes 150 described herein.

In the embodiment illustrated in FIG. 8, the second portion 204 projects outward and away from the first portion 202 so as to extend vertically above the first portion 202 and shelf 16 and into the airflow 28. Conversely, in the embodiment illustrated in FIG. 9, the second portion 204 is at least partially inserted into the outlet manifold 27; however, in other embodiments, the shell 200 (and integrated heat exchanger 100) of FIG. 9 may be positioned so that the second portion 204 may be at least partially inserted into the inlet manifold 25. In both the embodiments of FIGS. 8 and 9, the airflow 28 may contact the second portion 204 so as to transfer heat from or to the heat transfer fluid contained in the second portion 150*b* of heat pipes 150 as previously described.

Figure 10:
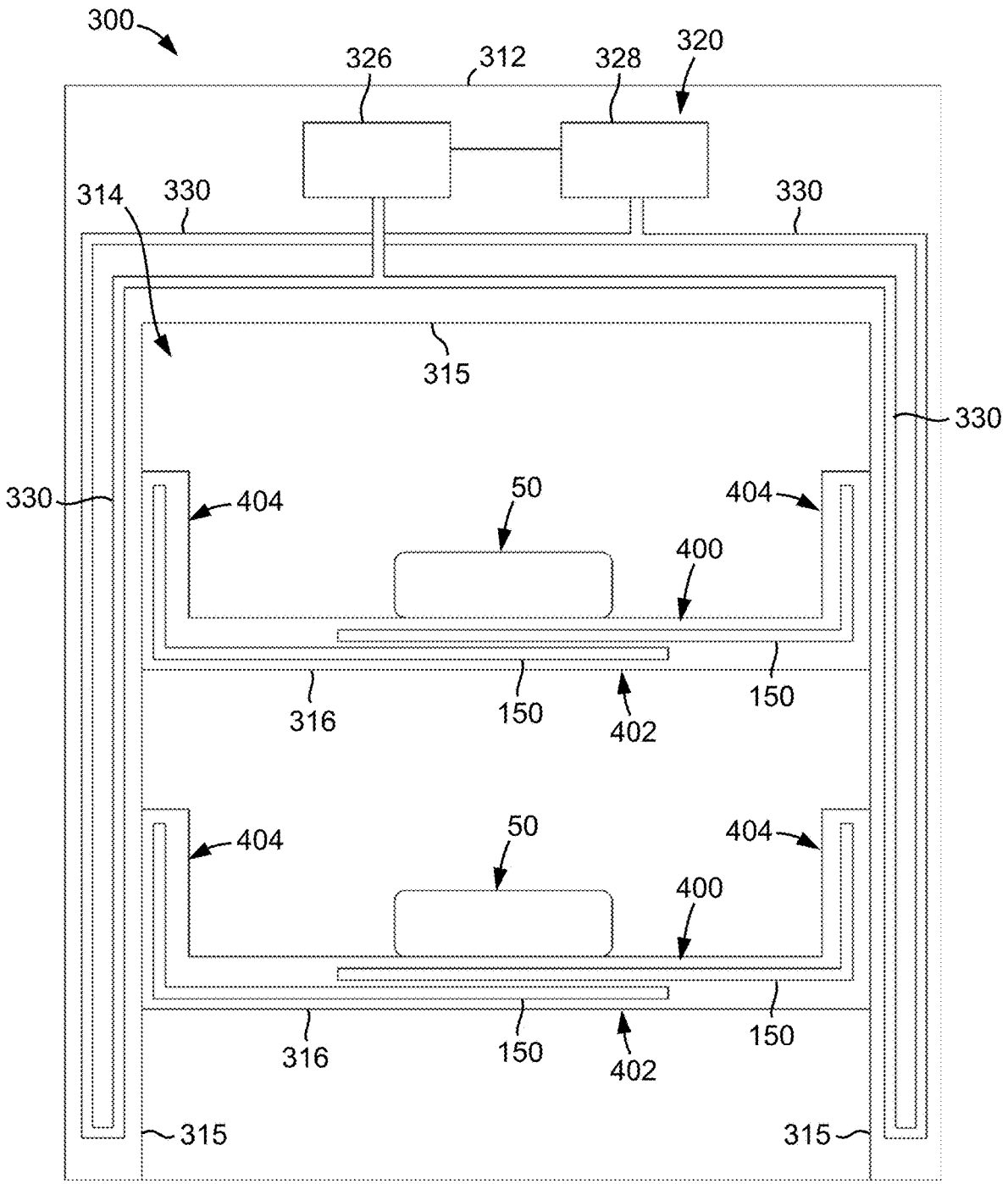
FIG. 10 is a schematic diagram of a freeze/thaw system that includes one or more auxiliary heat exchangers according to some embodiments disclosed herein.

While some embodiments of the freeze/thaw system 10 (FIG. 1) are configured to exchange heat with the packaged biologic substance 50 via forced-air convection, in other embodiments, a freeze/thaw system may utilize different heat transfer mechanisms and techniques. For instance, FIG. 10 shows a freeze/thaw system 300 for freezing or thawing one or more packaged biologic substances 50 that utilizes one or more auxiliary heat exchangers as previously described, but wherein the freeze/thaw system 300 does not utilize forced-air convention to transfer heat with the packaged biologic substance(s) 50. Rather, the freeze/thaw system 300 may be configured as a so-called "cold-wall" type device that utilizes on conduction and natural convection to exchange heat with the packaged biologic substance(s) 50 during operations.

In particular, the system 300 may include a housing or cabinet 312 that defines a chamber 314 therein. The one or more biologic substances 50 may be positioned in the chamber 314 on one or more shelves 316 (or other support surfaces) so that the freeze/thaw system 300 may controllably freeze or thaw the biologic substances 50 during operations.

In addition, the freeze/thaw system 300 includes one or more refrigeration assemblies 320 that are operably coupled to the chamber 314. Specifically, the chamber 14 may include a refrigeration assembly 320 that is configured to achieve and/or maintain a desired temperature (or temperature range) within the chamber 314 so as to freeze or thaw the one or more packaged biologic substance(s) 50 during operations. As previously described, the freeze/thaw system 300 may be configured as a so-called "cold-wall" device that does not utilize forced-convection through the chamber 314 to exchange heat with the packaged biologic substance(s) 50. Rather, the refrigeration assembly 320 may circulate heat transfer fluid through one or more coils (or coil banks) 330 that are arranged around one or more of the walls 315 of the housing 312 that define the chamber 314 so that heat may be exchanged between the chamber 314 and the one or more coils 330 via the walls 315 during operations.

More specifically, the refrigeration assembly 320 may include a compressor 326 and a condenser 328 that are fluidly connected to the one or more coils 330. During operations, the heat transfer fluid (which may comprise one or more refrigerants as previously described herein) may be compressed in the compressor 326, cooled in the condenser 328, and then expanded (e.g., via a suitable expander, valve, or other component) and routed through the one or more coils 330. The expansion of the compressed heat transfer fluid may further decrease a temperature thereof, so that the coils 330 may operate as a heat sink that receives heat from the chamber 314 via walls 315 as previously described. As the heat transfer fluid flows through the coil(s) 330, the heat transferred thereto from the chamber 314 via walls 315 may vaporize the heat transfer fluid so that the coil(s) 330 may comprise "evaporator coil(s)" (or an "evaporator") of the refrigeration assembly 320. The vaporized (and heated) heat transfer fluid may flow through the coil(s) 330 and back to compressor 326 to re-start the process described above.

In some embodiments, one or more heating coils, such as electrically resistive coils (not shown), may also be placed in the housing 312 about the walls 315 of chamber 314 to heat the chamber 314, such as when thawing the one or more packaged biologic substances 50. Additionally, or alternatively, the flow of heat transfer fluid may be reversed from that described above so that the refrigeration assembly 320 operates as a heat pump and the coils 330 may comprise a heat source that transfers heat to the chamber 314 via the walls 315 when thawing the one or more packaged biologic substances 50.

Thus, the refrigeration assembly 320 transfers heat with the chamber 314 via conduction through the walls 315 so as to freeze or thaw the packaged biologic substance(s) 50. Moreover, the refrigeration assembly 320 may not utilize forced convection to transfer heat with the one or more packaged biologic substances 50, and may (at most) induce natural convection with the chamber 314 via the temperature gradients present therein during operations.

In some embodiments, the refrigeration assembly 320 may comprise a so-called cascade refrigeration system, wherein multiple refrigeration cycles are defined therein to control (e.g., lower) the temperature of the heat transfer fluid circulated through the coil 330 during operations. Thus, in some embodiments, the refrigeration assembly 320 may comprise multiple refrigeration cycles (some of which may employ different refrigerants therein).

As may be appreciated from FIG. 10, while an airflow is not directed through the chamber 314, the primary heat exchange to/from the packaged biologic substances 50 may still be through and exposure to the atmosphere in the chamber 314. However, the temperature may not be uniform throughout the chamber 314 (due at least partially to the lack of a forced airflow therethrough), and may therefore vary depending on, for instance, the distance from one of the walls 315. In addition, as previously described for the freeze/thaw system 10, at least some surface area of the packaged biologic substances 50 (such as the portion engaged with the corresponding shelf 316) is occluded from the atmosphere in the chamber 314. As a result, heat transfer between the atmosphere 314 and the packaged biologic substances 50 may be non-uniform and partially restricted (e.g., along the occluded surfaces areas of the packaged biologic substances 50). Accordingly, the freeze/thaw system 300 may also include one or more auxiliary heat exchangers 400 that facilitate and enhance heat exchange with the packaged biologic substances 50 in a similar manner to that previously described above for the heat exchangers 100 of freeze/thaw system 10 (FIG. 1), so that the freeze/thaw system 300 may more uniformly and quickly change a temperature of the packaged biologic substances 50 during operations.

In particular, each of the auxiliary heat exchangers 400 may include a first portion 402 that is engaged with an outer surface of the corresponding packaged biologic substance 50, and one or more second portions 404 that are engaged with one or more of the walls 315. In addition, each of the heat exchangers 400 may include one or more heat pipes 150 that extend between the first portion 402 and second portion (s) 404 to thereby transfer heat therebetween as previously described.

In some embodiments (such as in the embodiment of FIG. 10), the first portion 402 may be integrated or coupled to the shelf 316 so that the first portion 402 may underlie and engage the corresponding packaged biologic substance 50. In addition, the second portions 404 may be engaged with and extended along corresponding ones of the walls 315. While the heat exchangers 400 shown in FIG. 10 include two second portions 404 that engage with two of the walls 315, it should be appreciated that in other embodiments, heat exchanger(s) 400 may include fewer or more second portions 404 (such as, one second portion 404, three second portions 404, etc.).

During operations, for each heat exchanger 400, when the freeze/thaw system 300 is operating to freeze the one or more biologic substances 50, the temperature of the walls 315 may be generally colder than the temperature of the corresponding packaged biologic substance 50 so that the packaged biologic substance 50 may be a heat source and the walls 315 may be a heat sink for the one or more heat pipes 150. As a result, heat transfer fluid contained in the heat pipe(s) 150 may vaporize in the first portion 402 and condense in the second portion(s) 404 to thereby transfer heat from the packaged biologic substance 50 to the walls 315 via the heat exchanger 400 as previously described. Conversely, again for each heat exchanger 400, when the freeze/thaw system 300 is operating to thaw the one or more biologic substances 50, the temperature of the walls 315 may be generally higher than the temperature of the corresponding packaged biologic substance 50 so that the walls 315 may be a heat source and the packaged biologic substance 50 may be a heat sink for the one or more heat pipes 150. As a result, heat transfer fluid contained in the heat pipe(s) 150 may vaporize in the second portion(s) 404 and condense in the first portion 402 to thereby transfer heat from the walls 315 to the packaged biologic substance 50 via the heat exchanger 400 as previously described.

However, during the above-noted operations, due to the lack of a forced airflow within the chamber 314, the second portion(s) 404 may primarily exchange heat via conductive heat transfer with the walls 315. In addition, while there is not a forced airflow within the chamber 314, additional heat exchange may occur between the second portion(s) 404 and the walls 315 (and/or atmosphere of the chamber 314) via natural convection during operations. As a result, as was previously described with the heat exchangers 100, the heat exchangers 400 may operate to more efficiently and quickly freeze or thaw the packaged biologic substances 50 within chamber 314 during operations.

In addition, as was also previously described for heat exchangers 100, the heat exchangers 400 may have a number of different configurations in various embodiments. For instance, the heat exchangers 400 may be configured as separate members or bodies that are supported on the shelves 316, underneath the packaged biologic substances 50, similar to the heat exchangers shown in FIGS. 1 and 2. In addition, in some embodiments, the second portion 404 (or one or more of the second portions 404) of heat exchangers 400 may be at least partially inserted into slots or apertures formed in the walls so as to increase a surface area contact between the second portion(s) 404 and walls 315 and/or coil 330 during operations. Further, in some embodiments, the heat exchangers 400 may include a plurality of heat pipes 150 that are configured to most efficiently transfer heat between the packaged biologic substance 50 and walls 315 over a plurality of different (and potentially overlapping) temperature ranges of the packaged biologic substances 50 as previously described. Still further, in some embodiments the heat exchangers 400 may be incorporated into a shell or other container that at least partially surrounds the packaged biologic substances 50, similar to the heat exchangers 200 shown in FIGS. 8 and 9.

As explained above and reiterated below, the present disclosure includes, without limitation, the following example implementations.

Clause 1: a system for changing a temperature of a packaged biologic substance, the system comprising: a chamber configured to receive the packaged biologic substance; a refrigeration assembly configured to generate an airflow through the chamber to change a temperature of the packaged biologic substance; and an auxiliary heat exchanger at least partially positioned in the chamber, the auxiliary heat exchanger comprising at least one heat pipe that is configured to transfer heat between the packaged biologic substance and the airflow.

Clause 2: The system of any of the clauses, wherein the auxiliary heat exchanger comprises: a first portion that is configured to contact the packaged biologic substance; and a second portion that is configured to be exposed to the airflow, wherein the at least one heat pipe is configured to transfer heat between the first portion and the second portion.

Clause 3: The system of any of the clauses, wherein the first portion is configured to underly the packaged biologic substance, and wherein the second portion extends at a non-zero angle relative to the first portion.

Clause 4: The system of any of the clauses, further comprising ducting configured to circulate the airflow between the refrigeration assembly and the chamber, wherein the second portion is at least partially positioned in the ducting.

Clause 5: The system of any of the clauses, wherein the chamber includes a shelf, and wherein the auxiliary heat exchanger is at least partially integrated into the shelf.

Clause 6: The system of any of the clauses, wherein the first portion is configured as a shell that is configured to at least partially enclose the packaged biologic substance.

Clause 7: The system of any of the clauses, wherein the auxiliary heat exchanger comprises a plurality of heat pipes, wherein the at least one heat pipe is one of the plurality of heat pipes, wherein a first heat pipe of the plurality of heat pipes contains a first refrigerant and is configured to change a phase of the first refrigerant over a first temperature range of the packaged biologic substance, wherein a second heat pipe of the plurality of heat pipes contains a second refrigerant and is configured to change a phase of the second refrigerant over a second temperature range of the packaged biologic substance, and wherein the first temperature range is different from the second temperature range.

Clause 8: The system of any of the clauses, wherein the first heat pipe contains a first charge of the first refrigerant, wherein the second heat pipe contains a second charge of the second refrigerant, and wherein at least one of: the first charge is different from the second charge; or the first refrigerant is different from the second refrigerant.

Clause 9: The system of any of the clauses, wherein the at least one heat pipe comprises a slugging heat pipe.

Clause 10: A method of changing a temperature of a packaged biologic substance, the method comprising: (a) contacting the packaged biologic substance with a first portion of an auxiliary heat exchanger within a chamber, the auxiliary heat exchanger also including a second portion and at least one heat pipe extending between the first portion and the second portion; (b) generating an airflow with a refrigeration assembly; and (c) circulating the airflow between the chamber and the refrigeration assembly so that the airflow: (i) contacts the packaged biologic substance in the chamber to transfer heat between the packaged biologic substance and the airflow, and (ii) contacts the second portion of the auxiliary heat exchanger to transfer heat between the packaged biologic substance and the airflow via the heat pipe.

Clause 11: The method of any of the clauses, wherein (c) further comprises directing the airflow through ducting positioned between the refrigeration assembly and the chamber so that the airflow contacts the second portion of the auxiliary heat exchanger in the ducting.

Clause 12: The method of any of the clauses, wherein (c) further comprises circulating the airflow between the chamber and the refrigeration assembly so that the airflow contacts the second portion of the auxiliary heat exchanger in the chamber.

Clause 13: The method of any of the clauses, wherein the auxiliary heat exchanger includes a plurality of heat pipes extending between the first portion and the second portion, wherein the at least one heat pipe is one of the plurality of heat pipes, wherein a first heat pipe of the plurality of heat pipes contains a first refrigerant and is configured to change a phase of the first refrigerant over a first temperature range of the packaged biologic substance, wherein a second heat pipe of the plurality of heat pipes contains a second refrigerant and is configured to change a phase of the second refrigerant over a second temperature range of the packaged biologic substance, wherein the first temperature range is different from the second temperature range, and wherein the method further comprises changing a temperature of the airflow with the refrigeration assembly so that: during a first time period, the temperature of the packaged biologic substance corresponds with the first temperature range of the first heat pipe, and during a second time period the temperature of the packaged biologic substance corresponds with the second temperature range of the second heat pipe.

Clause 14: The method of any of the clauses, wherein (c) comprises freezing or thawing the packaged biologic substance with the airflow.

Clause 15: a system for cooling a packaged biologic substance, the system comprising: a chamber; a refrigeration assembly configured to cool the packaged biologic substance in the chamber; and an auxiliary heat exchanger at least partially positioned in the chamber, the auxiliary heat exchanger comprising: a first portion that is configured to contact at least a portion of a surface area of the packaged biologic substance; a second portion that is spaced from the packaged biologic substance; and a heat pipe extending between the first portion and the second portion, wherein the heat pipe contains a refrigerant that is configured to change phase to transfer heat from the first portion to the second portion to cool the packaged biologic substance.

Clause 16: The system of any of the clauses, wherein the refrigeration assembly is configured to generate and airflow through the chamber to cool the packaged biologic substance, and wherein the second portion of the auxiliary heat exchanger is configured to be exposed to the airflow.

Clause 17: The system of any of the clauses, wherein the first portion is configured to underlie the packaged biologic substance, and wherein the second portion extends at a non-zero angle relative to the first portion.

Clause 18: The system of any of the clauses, further comprising ducting configured to circulate the airflow between the refrigeration assembly and the chamber, wherein the second portion is at least partially positioned in the ducting.

Clause 19: The system of any of the clauses, wherein the second portion is engaged with a wall of the chamber.

Clause 20: The system of any of the clauses, wherein the auxiliary heat exchanger comprises a plurality of heat pipes, wherein the heat pipe is one of the plurality of heat pipes, wherein a first heat pipe of the plurality of heat pipes contains a first refrigerant and is configured to change a phase of the first refrigerant over a first temperature range of the packaged biologic substance, wherein a second heat pipe of the plurality of heat pipes contains a second refrigerant and is configured to change a phase of the second refrigerant over a second temperature range of the packaged biologic substance, and wherein the first temperature range is different from the second temperature range.

The embodiments disclosed herein utilize one or more additional auxiliary heat exchangers within a chamber of a freeze/thaw system to promote heat exchange with one or more surfaces of a biologic substance that may be at least partially occluded from an airflow. In some embodiments, the additional auxiliary heat exchanger(s) may each include one or more heat pipes that are configured to exchange between the at least partially occluded surface(s) of the biologic substance and the airflow within the chamber. Thus, through use of the embodiments disclosed herein, a biologic substance may be more evenly and quickly frozen or thawed within a freeze/thaw system (such as a freeze/thaw system that utilizes forced-air convection or another form of heat transfer such as conduction, radiation, natural convection, etc.).

The preceding discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the discussion herein and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Further, when used herein (including in the claims), the words "about," "generally," "substantially," "approximately," and the like, when used in reference to a stated value mean within a range of plus or minus 10% of the stated value.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A system for changing a temperature of a packaged biologic substance, the system comprising:

a chamber configured to receive the packaged biologic substance;

a refrigeration assembly configured to generate an airflow through the chamber to change the temperature of the packaged biologic substance; and an auxiliary heat exchanger at least partially positioned in the chamber, the auxiliary heat exchanger comprising:

at least one heat pipe that is configured to transfer heat between the packaged biologic substance and the airflow;

a first portion that is configured to contact at least a portion of the packaged biologic substance; and a second portion that is configured to be exposed to the airflow through the chamber, wherein the second portion extends at a non-zero angle relative to the first portion, and wherein the second portion is located entirely in the chamber.

2. The system of claim 1, wherein the system operates at a temperature ranging from about 0° C. to about −40° C.

3. The system of claim 1, wherein the first portion is configured to underlie the packaged biologic substance.

4. The system of claim 1, further comprising ducting configured to circulate the airflow between the refrigeration assembly and the chamber.

5. The system of claim 1, wherein the chamber includes a shelf, and wherein the auxiliary heat exchanger is at least partially integrated into the shelf.

6. The system of claim 1, wherein the first portion is configured as a shell that is configured to at least partially enclose the packaged biologic substance.

7. The system of claim 1, wherein the auxiliary heat exchanger comprises a plurality of heat pipes, wherein the at least one heat pipe is one of the plurality of heat pipes, wherein a first heat pipe of the plurality of heat pipes contains a first refrigerant and is configured to change a phase of the first refrigerant over a first temperature range of the packaged biologic substance, wherein a second heat pipe of the plurality of heat pipes contains a second refrigerant and is configured to change a phase of the second refrigerant over a second temperature range of the packaged biologic substance, and wherein the first temperature range is different from the second temperature range.

8. The system of claim 7, wherein the first heat pipe contains a first charge of the first refrigerant, wherein the second heat pipe contains a second charge of the second refrigerant, and wherein at least one of:

the first charge is different from the second charge; or the first refrigerant is different from the second refrigerant.

9. The system of claim 1, wherein the at least one heat pipe comprises a slugging heat pipe.

10. A method of changing a temperature of a packaged biologic substance, the method comprising:

(a) contacting the packaged biologic substance with a first portion of an auxiliary heat exchanger within a chamber, the auxiliary heat exchanger also including a second portion and at least one heat pipe extending between the first portion and the second portion;

(b) generating an airflow through the chamber with a refrigeration assembly; and (c) circulating the airflow between the chamber and the refrigeration assembly so that the airflow:

(i) contacts the packaged biologic substance in the chamber to transfer heat between the packaged biologic substance and the airflow, and (ii) contacts the second portion of the auxiliary heat exchanger to transfer heat between the packaged biologic substance and the airflow via the heat pipe, wherein the second portion is configured to be exposed to the airflow through the chamber, the second portion extends at a non-zero angle relative to the first portion, and the second portion is located entirely in the chamber.

11. The method of claim 10, wherein (c) further comprises directing the airflow through ducting positioned between the refrigeration assembly and the chamber so that the airflow contacts the second portion of the auxiliary heat exchanger.

12. The method of claim 10, wherein (c) further comprises circulating the airflow between the chamber and the refrigeration assembly so that the airflow contacts the second portion of the auxiliary heat exchanger in the chamber.

13. The method of claim 10, wherein the auxiliary heat exchanger includes a plurality of heat pipes extending between the first portion and the second portion, wherein the at least one heat pipe is one of the plurality of heat pipes, wherein a first heat pipe of the plurality of heat pipes contains a first refrigerant and is configured to change a phase of the first refrigerant over a first temperature range of the packaged biologic substance, wherein a second heat pipe of the plurality of heat pipes contains a second refrigerant and is configured to change a phase of the second refrigerant over a second temperature range of the packaged biologic substance, wherein the first temperature range is different from the second temperature range, and wherein the method further comprises changing a temperature of the airflow with the refrigeration assembly so that:

during a first time period, the temperature of the packaged biologic substance corresponds with the first temperature range of the first heat pipe, and during a second time period the temperature of the packaged biologic substance corresponds with the second temperature range of the second heat pipe.

14. The method of claim 10, wherein (c) comprises freezing or thawing the packaged biologic substance with the airflow.

15. A system for cooling a packaged biologic substance, the system comprising:

a chamber;

a refrigeration assembly configured to generate an airflow through the chamber to cool the packaged biologic substance in the chamber; and an auxiliary heat exchanger at least partially positioned in the chamber, the auxiliary heat exchanger comprising:

a first portion that is configured to contact at least a portion of a surface area of the packaged biologic substance;

a second portion that is spaced from the packaged biologic substance, wherein the second portion is configured to be exposed to the airflow through the chamber, wherein the second portion extends at a non-zero angle relative to the first portion, and wherein the second portion is located entirely in the chamber; and a heat pipe extending between the first portion and the second portion, wherein the heat pipe contains a refrigerant that is configured to change phase to transfer heat from the first portion to the second portion to cool the packaged biologic substance.

16. The system of claim 15, wherein the first portion is configured to underlie the packaged biologic substance.

17. The system of claim 15, further comprising ducting configured to circulate the airflow between the refrigeration assembly and the chamber.

18. The system of claim 15, wherein the second portion is engaged with a wall of the chamber.

19. The system of claim 15, wherein the auxiliary heat exchanger comprises a plurality of heat pipes, wherein the heat pipe is one of the plurality of heat pipes, wherein a first heat pipe of the plurality of heat pipes contains a first refrigerant and is configured to change a phase of the first refrigerant over a first temperature range of the packaged biologic substance, wherein a second heat pipe of the plurality of heat pipes contains a second refrigerant and is configured to change a phase of the second refrigerant over a second temperature range of the packaged biologic substance, and wherein the first temperature range is different from the second temperature range.

20. The system of claim 15, wherein the system operates at a temperature ranging from about 0° C. to about −40° C.

* * * * *